US008547229B2

(12) United States Patent
Brodzik et al.

(10) Patent No.: US 8,547,229 B2
(45) **Date of Patent: *Oct. 1, 2013**

(54) MULTI-ATTACH DISPOSABLE TAG

(75) Inventors: James Brodzik, Somerdale, NJ (US); Anthony F. Piccoli, West Deptford, NJ (US); Lawrence Appalucci, Villanova, PA (US); Gary Mazoki, Sewell, NJ (US); Thomas J. McKeown, Pennsauken, NJ (US); Seth Strauser, Sewell, NJ (US); Wei Wu, Shanghai (CN)

(73) Assignee: Checkpoint Systems, Inc., Thorofare, NJ (US)

( * ) Notice: Subject to any disclaimer, the term of this patent is extended or adjusted under 35 U.S.C. 154(b) by 139 days.

This patent is subject to a terminal disclaimer.

(21) Appl. No.: 13/193,020

(22) Filed: Jul. 28, 2011

(65) Prior Publication Data

US 2012/0019385 A1 Jan. 26, 2012

Related U.S. Application Data

(63) Continuation-in-part of application No. 12/887,229, filed on Sep. 21, 2010, which is a continuation-in-part of application No. 12/482,934, filed on Jun. 11, 2009, now Pat. No. 8,344,891.

(60) Provisional application No. 61/163,677, filed on Mar. 26, 2009, provisional application No. 61/157,237, filed on Mar. 4, 2009.

(51) Int. Cl.

| | |
|---|---|
| ***G08B 13/14*** | (2006.01) |
| ***E05B 63/00*** | (2006.01) |
| ***E05B 65/00*** | (2006.01) |
| ***E05B 69/00*** | (2006.01) |

(52) U.S. Cl.

USPC ..... 340/568.1; 340/568.4; 340/568.5; 340/571; 340/572.1; 70/4; 70/6; 70/57.1; 70/58

(58) Field of Classification Search

None

See application file for complete search history.

(56) References Cited

U.S. PATENT DOCUMENTS 4,502,305 A * 3/1985 Bakker ..... 70/49
4,546,345 A 10/1985 Naito (Continued)

FOREIGN PATENT DOCUMENTS

CN 201122327 Y 9/2008
EP 1548640 6/2005

(Continued)

OTHER PUBLICATIONS

International Search Report for related PCT Application No. PCT/US2011/051593 dated Feb. 17, 2012.

(Continued)

*Primary Examiner* — Julie Lieu

(74) *Attorney, Agent, or Firm* — Caesar, Rivise, Bernstein, Cohen & Pokotilow, Ltd.

(57) ABSTRACT

A multi-attach disposable security tag that is attached to an article in two stages. In a first stage, an attachment clip is coupled to an article, such as but not limited to clothing, to be protected by a manufacturer or assembler. This attachment clip is durable to withstand harsh manufacturing environments. Once the article with the attachment clip is ready for presentation, for example, at a retail establishment, during a second stage, the attachment clip is then permanently secured in a locking mechanism of a housing containing a deactivatable security element therein. The security element may comprise EAS (including AM, RF, EM and microwave), RFID (including LF, HF and UHF) elements or any combination thereof. A preferred embodiment of the security tag uses all non-ferrous components including its locking mechanism. Thus, the security tags combine the qualities of being non-ferrous, light-weight, low cost, deactivatable, secure, visually-deterring, and installable in two stages to the article it is meant to protect.

20 Claims, 12 Drawing Sheets

(56) References Cited

U.S. PATENT DOCUMENTS

| | | | | |
|---|---|---|---|---|
| 5,070,581 | A | 12/1991 | Senter | |
| 5,508,684 | A * | 4/1996 | Becker | 340/572.5 |
| 5,515,580 | A | 5/1996 | McHenry, Jr. | |
| 5,524,463 | A * | 6/1996 | Schenkel et al. | 70/57.1 |
| 5,583,489 | A | 12/1996 | Loemker et al. | |
| 5,615,454 | A | 4/1997 | Contarino | |
| 5,627,520 | A * | 5/1997 | Grubbs et al. | 340/572.1 |
| 5,689,237 | A | 11/1997 | Sasagawa et al. | |
| 5,699,591 | A | 12/1997 | Kane | |
| 5,945,909 | A * | 8/1999 | Kolton | 340/572.1 |
| 5,969,613 | A * | 10/1999 | Yeager et al. | 340/572.9 |
| 6,052,876 | A | 4/2000 | Hogan et al. | |
| 6,188,320 | B1 * | 2/2001 | Kolton et al. | 340/572.9 |
| 6,254,953 | B1 | 7/2001 | Elston | |
| 6,380,855 | B1 | 4/2002 | Ott | |
| 6,624,753 | B2 | 9/2003 | Elston | |
| 6,646,554 | B1 | 11/2003 | Goff et al. | |
| 6,780,265 | B2 | 8/2004 | Bleckmann et al. | |
| 7,129,841 | B2 | 10/2006 | Feibelman | |
| 7,183,914 | B2 | 2/2007 | Norman et al. | |
| 7,183,917 | B2 | 2/2007 | Piccoli et al. | |
| 7,227,467 | B2 | 6/2007 | Feibelman | |
| 7,456,741 | B2 | 11/2008 | Norman et al. | |
| 7,474,209 | B2 * | 1/2009 | Marsilio et al. | 340/568.1 |
| 7,518,521 | B2 * | 4/2009 | Feibelman et al. | 340/572.9 |
| 7,808,390 | B2 | 10/2010 | Sayegh | |
| 2005/0128089 | A1 * | 6/2005 | Feibelman | 340/572.9 |
| 2006/0026809 | A1 * | 2/2006 | Copen et al. | 24/704.1 |
| 2006/0170550 | A1 * | 8/2006 | Marsilio et al. | 340/568.2 |
| 2006/0238343 | A1 * | 10/2006 | Leyden et al. | 340/572.1 |
| 2007/0067971 | A1 * | 3/2007 | Nguyen et al. | 24/704.1 |
| 2009/0135014 | A1 | 5/2009 | Bleckmann et al. | |
| 2010/0225485 | A1 | 9/2010 | Appalucci et al. | |
| 2011/0199210 | A1 * | 8/2011 | McLean | 340/568.1 |

FOREIGN PATENT DOCUMENTS

| | | |
|---|---|---|
| EP | 1171300 | 11/2005 |
| GB | 2187706 | 9/1987 |
| GB | 2305212 | 4/1997 |
| JP | 2002074530 | 3/2002 |
| KR | 20030079036 | 10/2003 |
| KR | 20050020918 | 3/2005 |
| WO | 98/40591 | 9/1998 |
| WO | 2006127674 | 11/2006 |
| WO | 2008/068725 | 6/2008 |

OTHER PUBLICATIONS

International Search Report for related PCT Application No. PCT/US2009/047245 dated Oct. 20, 2009.

* cited by examiner

FIG.1
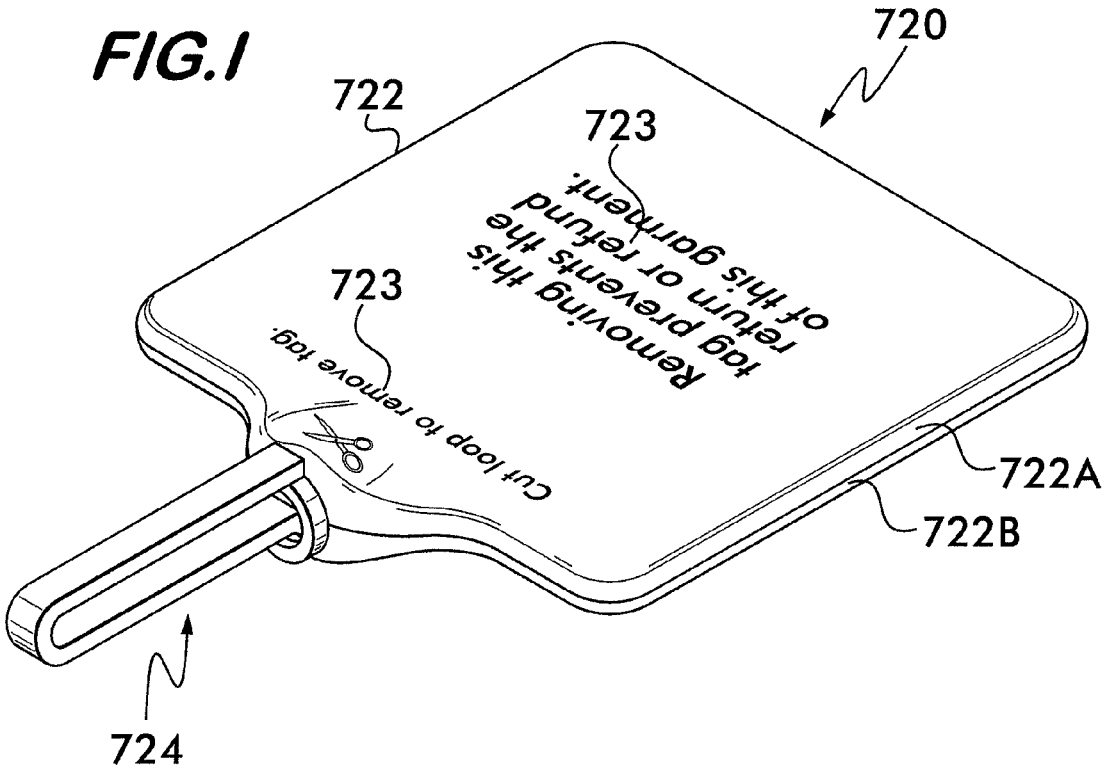
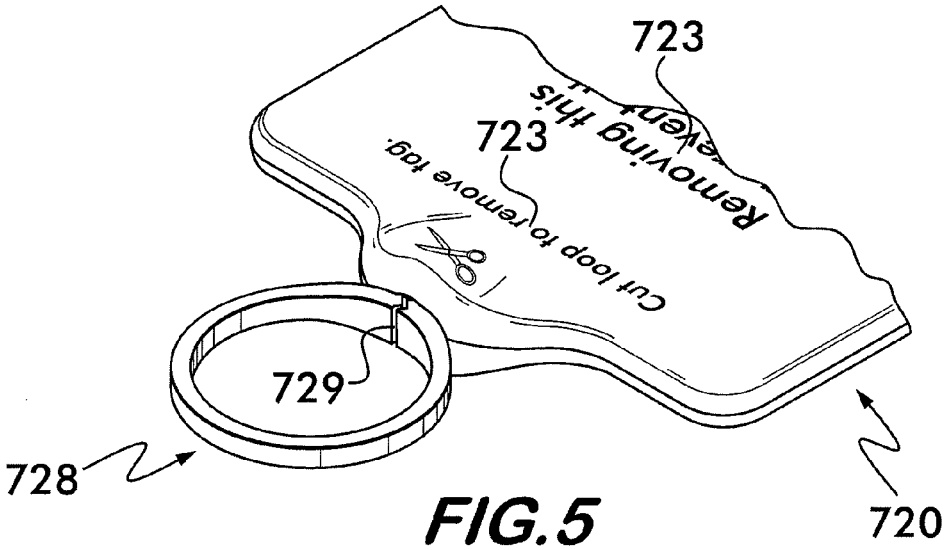
FIG.5

FIG.17
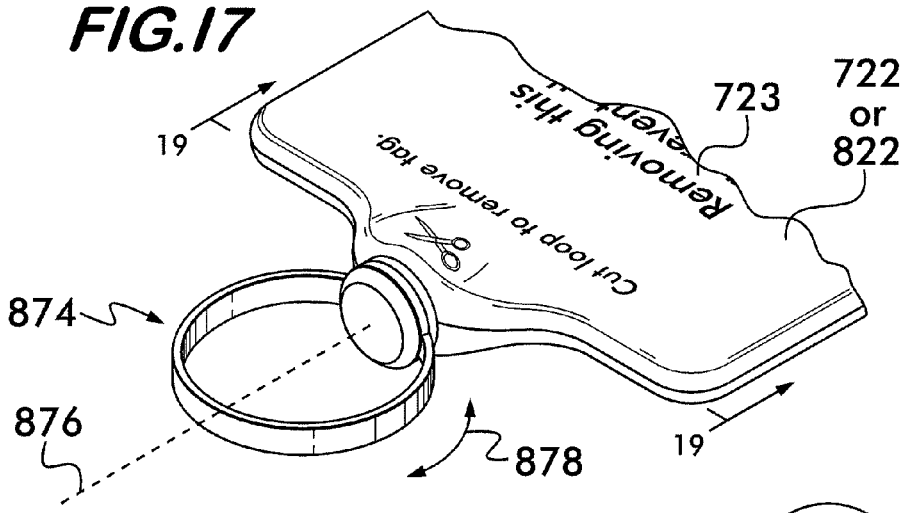
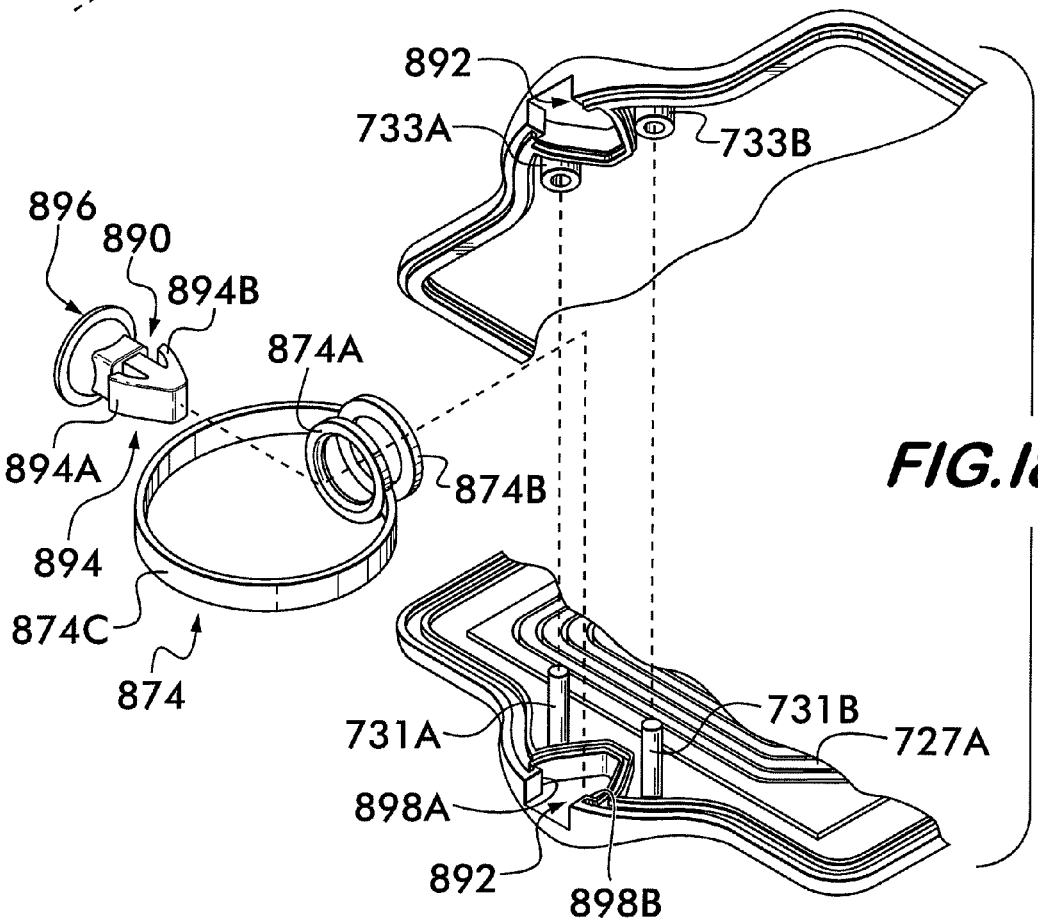
FIG.18

FIG.24
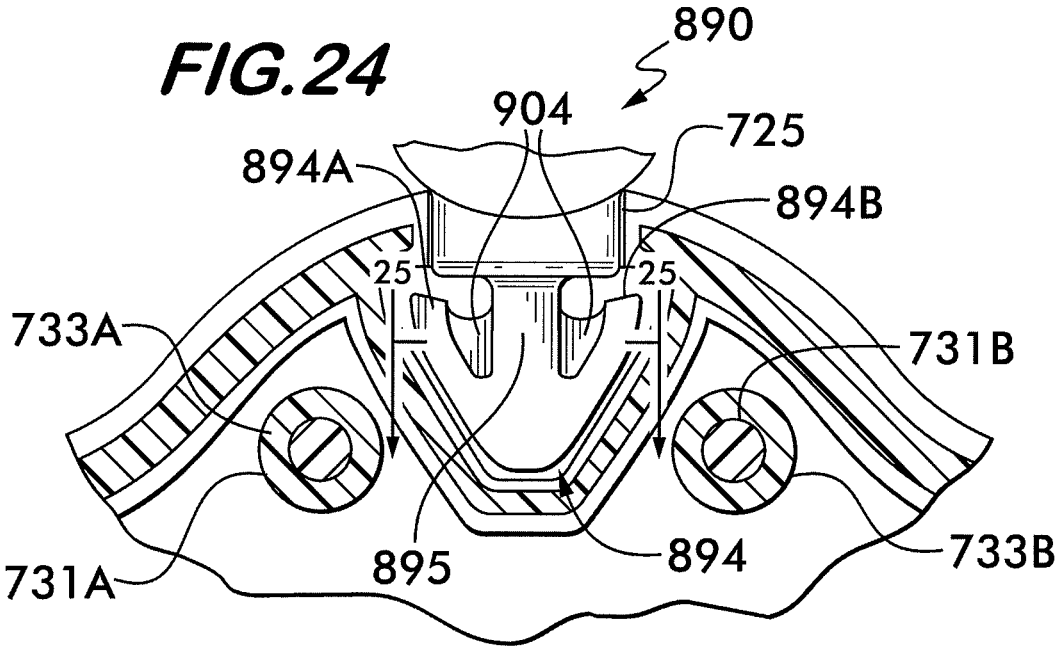
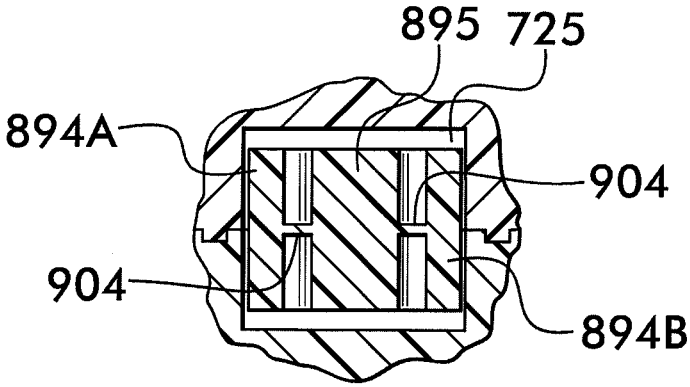
FIG.25

MULTI-ATTACH DISPOSABLE TAG

CROSS-REFERENCE TO RELATED APPLICATIONS

This continuation-in-part application claims the benefit under 35 U.S.C. §120 of application Ser. No. 12/887,229 filed on Sep. 21, 2010 entitled TWO-STAGE UNIVERSAL SECURITY HARD TAG AND METHOD FOR ATTACHING AND DETACHING which in turn is a continuation-in-part application which claims the benefit under 35 U.S.C. §120 of application Ser. No. 12/482,934 filed on Jun. 11, 2009 entitled SECURITY HARD TAG WITH ATTACHMENT CLIP AND METHOD FOR ATTACHING AND DETACHING which, in turn, claims the benefit under 35 U.S.C. §119 (e) of Provisional Application Ser. No. 61/157,237 filed on Mar. 4, 2009 entitled NON-FERROUS HARD TAG and of Provisional Application Ser. No. 61/163,677 filed on Mar. 26, 2009 also entitled NON-FERROUS HARD TAG and all of whose entire disclosures are incorporated by reference herein.

BACKGROUND OF THE INVENTION

1. Field of Invention

The present invention generally relates to the field of security tags, and more particularly, to hard tags which are coupled to articles.

2. Description of Related Art

Many apparel items are tagged (i.e., a security device or element applied) at the source. These security devices may comprise electronic article surveillance (EAS) elements, radio frequency identification (RFID) elements or combinations of such security devices, etc., and which can be wirelessly detected at business portals, e.g., store exits or points of sale (POS), etc. to prevent or diminish theft from the business. Most conventional hard tags on the market utilize a metallic pin and lock mechanism to secure the tag to an article (e.g., clothing) for protecting the article against theft. Once the hard tag is then installed on or with the article, to prevent any broken sewing needle from imbedding itself into the clothing and possibly causing harm to the end user, especially children, the article is subjected to a required needle detector test. The needle detector (e.g., the HN-25 Needle Detector by Hashima Co. Ltd. of Japan) senses a change in magnetic field and alarms if a ferrous metal enters into its sensing field; these detectors typically have two settings based on the quantity of iron in a steel ball of 0.8 mm (high) or 1.2 mm (low). There are also significant legal liabilities if a broken needle leaves the factory.

Conventional security tags such as EAS hang tags, sewn-in woven tags, and drop-in-pocket tags are non-ferrous, light weight, low cost, and deactivatable, but they are not visually-deterring and cannot be secured (at least in part) prior to harsh manufacturing conditions (e.g., stone-washing of jeans). Furthermore, EAS hang tags attached by a plastic strap and un-attached drop-in-pocket tags can easily be removed and are not secure.

Magnetic hard tags are visually deterring and secure (by a metal pin), but they are not non-ferrous, light weight, low cost, deactivatable, or capable of being secured prior to harsh manufacturing conditions. Rather, these tags must be removed at checkout (rather than being deactivated), and are normally secured by a metal (ferrous) pin after the object to be tagged has undergone any harsh manufacturing conditions.

In addition, the actual tagging of the security device/element to the apparel can affect the presentation of the apparel by either puncturing the apparel (e.g., pin and receptacle) or by adhering to the apparel, or by being embedded (e.g., sewn) within the apparel. Further, the weight of the tag may distort or wrinkle the fabric when the apparel is positioned on the hanger, the mannequin, or other display.

This is most apparent in many apparel items such as intimates, bathing suits and accessories but also occurs with soft goods. Soft goods include homeware items such as bedding, towels, fabrics, etc. Thus, these types of goods do not favor the known security devices and methods for attaching such devices due to the size of the goods or the invasive nature of the products known in the art. The attachment of a security device embedded in packaging for apparel, linens and soft goods is known in the art. A woven label such as that shown in U.S. Pat. No. 6,780,265 (Bleckmann, et al.) has an embedded EAS or RFID device.

The method of attaching such a woven label by a sewing machine is also known in the art. Other methods are disclosed where the device is embedded within a paper ticket, price tag or hang tag (swing ticket). These products are also attached by known methods. By way of example, see U.S. Pat. No. 5,508,684 (Becker); U.S. Pat. No. 5,583,489 (Loemaker, et al.); U.S. Pat. No. 6,254,953 (Elston); and EP 1171300 (Bleckmann, et al.). But as discussed above, sewn-in woven tags are not visually-deterring and cannot be secured (at least in part) prior to harsh manufacturing conditions.

Moreover, where RFID security devices are used, many people have an apprehension with such devices when they are used in connection with personal items because it harbors connotations of invasion of privacy. RFID security devices typically include a memory regarding the item itself. Where such security devices are sewn into apparel, people are reluctant to purchase apparel that may permanently contain a device that may store information and which cannot be removed without damaging the apparel. Thus, the use of RFID security devices tends to increase the "impact" of such security devices on apparel.

One solution, U.S. Patent Publication No. 2006/0026809 (application Ser. No. 11/237,368 filed Sep. 28, 2005), entitled "Theft Deterrent Device," which is owned by the same Assignee, namely, Checkpoint Systems, Inc., as the present application, and which is incorporated by reference herein in its entirety, discloses several embodiments, one of which (referred to as a "slotted EAS tag holder") has a housing and an attachment cable, but the attachment cable can only be attached to the article by being attached to the housing. As a result, this security tag cannot undergo harsh manufacturing conditions. In addition, this security tag does not utilize a deactivatable security element.

Another solution is that disclosed in U.S. Patent Publication No. 2010/0225485 (application Ser. No. 12/482,934, filed Jun. 11, 2009), entitled "Security Hard Tag with Attachment Clip and Method for Attaching and Detaching" and which is owned by the same Assignee, namely, Checkpoint Systems, Inc., as the present application. In particular, application Ser. No. 12/482,934 discloses a non-ferrous, light weight, low cost, secure, and visually-deterring tag; however, this tag is not deactivatable and cannot undergo harsh manufacturing conditions.

To overcome these problems, U.S. Patent Publication No. 2011/0018716 (application Ser. No. 12/887,229 filed Sep. 21, 2010) entitled "Two-Stage Universal Security Hard Tag and Method for Attaching and Detaching" and which is owned by the same Assignee, namely, Checkpoint Systems, Inc., as the present application, and which is incorporated by reference herein in its entirety, discloses a deactivatable whose working portion is not installed until after the harsh manufacturing conditions.

However, in view of the foregoing, there remains a need for a security tag that can combine the qualities of being non-ferrous, light weight, low cost, re-usable, secure, visually-deterring, and capable of being attached (at least in part) at the source (e.g., a garment factory) prior to harsh manufacturing conditions (e.g., stone washing of jeans).

BRIEF SUMMARY OF THE INVENTION

A security tag adapted for securing to an article (e.g., an article such as, but not limited to, clothing, especially children's clothing, lingerie, shoes, shirts, pants, swimwear and most outerwear, etc.) is disclosed. The security tag comprises: a housing; a locking mechanism positioned along an edge of the housing; an attachment clip comprising a first portion configured to secure to the article independently of the housing; and a second portion configured to permanently secure within the locking mechanism of the housing, wherein at least a portion of the attachment clip is rotatable with respect to the housing; and a deactivatable security element (e.g., EAS (including AM, RF, EM and microwave), RFID (including LF, HF and UHF), benefit denial (e.g., ink-filled or faux dye-filled capsules) or any combination thereof, etc.) associated with the housing, wherein the security element prevents or hinders a theft of the article.

One of the key features of the present invention is to allow the flexibility of using one housing with multiple attachment methods by just using a different low cost attachment clip. This facilitates reducing manufacturing and inventory costs also by mass producing the high cost item (i.e., the housing) while maintaining an inventory of the low cost attachment clip

BRIEF DESCRIPTION OF SEVERAL VIEWS OF THE DRAWINGS

The invention will be described in conjunction with the following drawings in which like reference numerals designate like elements and wherein:

FIG. 1 is an isometric view of a disposable embodiment of the present invention that comprises a deactivatable security element therein;

FIG. 5 is a partial view of the disposable embodiment using a second attachment clip, also referred to as a "round split clip" and which also comprises a double barb;

FIG. 17 is a partial isometric view of a two piece rotatable attachment clip coupled to the disposable tag housing;

FIG. 18 is a partial exploded view of the disposable tag housing of FIG. 17 and showing how the ends of the attachment clip are aligned so that a connecting element can be passed therethrough and into the disposable housing;

FIG. 24 is an enlarged plan and cross-sectional view of the disposable embodiment using a "webbed" dual barb with the rotatable attachment clip; and FIG. 25 is an enlarged cross-sectional view of the disposable embodiment taken along line 25-25 of FIG. 24.

DETAILED DESCRIPTION OF THE INVENTION

Figure 2:
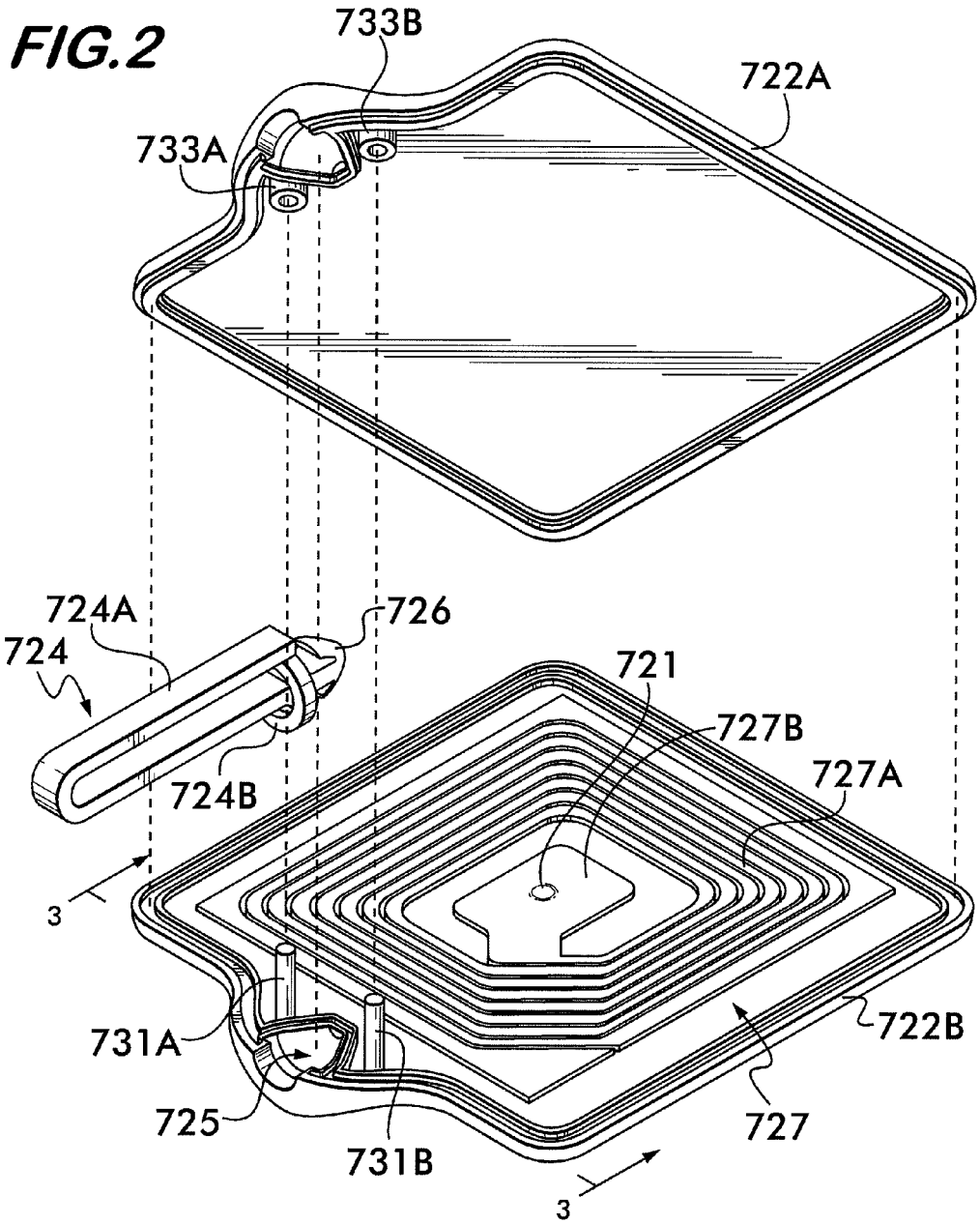
FIG. 2 is an exploded view of the disposable embodiment of FIG. 1 showing an exemplary coil/capacitor resonant circuit that is deactivatable and a first attachment clip having a double barb.
Figure 3:
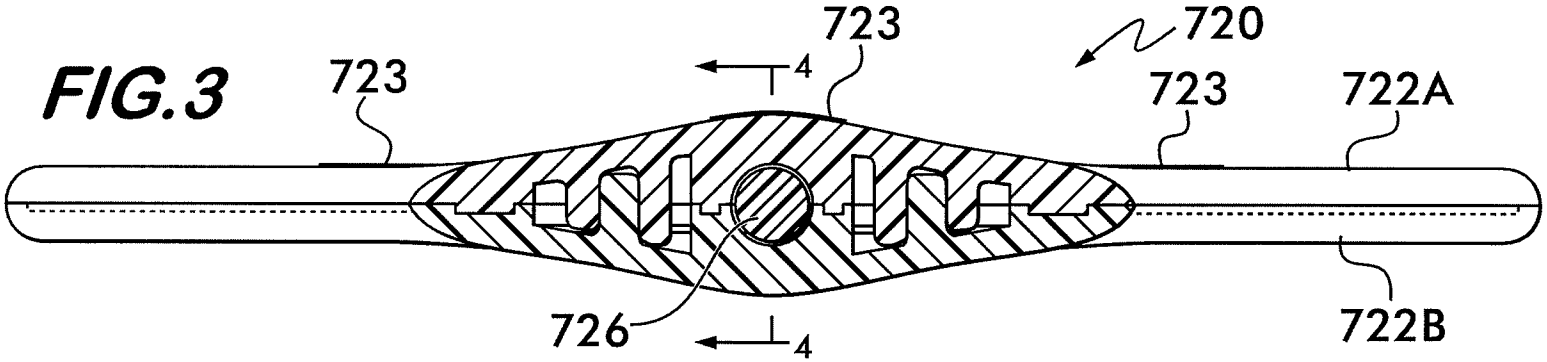
FIG. 3 is a partial cross-sectional view of the disposable embodiment taken along line 3-3 of FIG. 2.

The present invention provides a novel security hard tag that can be attached to a variety of items with minimal impact to the presentation of the article to potential customers of the article, reducing the weight of conventional hard tags, complying with needle tests and being versatile to include any type of security element technology such as, but not limited to: EAS (electronic article surveillance, which includes acoustomagnetic (AM), RF, EM and microwave), RFID (radio frequency identification, which includes LF, HF and UHF), benefit denial (e.g., ink-filled or faux dye-filled capsules that eject ink/dye upon illicit attempts to remove capsule, or visual alarm, or audible alarm or tactile alarm or any item that cannot be removed from the article (unless the article is purchased) that hinders or prevents the theft and/or denies the benefit of the article to the would-be thief) or any combination thereof. Therefore, whether the security element involves wireless transmissions (e.g., responding to a magnetic or electromagnetic field of a particular frequency or frequencies, or operates independently of any wireless transmissions (e.g., benefit-denial, visual/audible/tactile alarms, or anything that would draw attention to the non-authorized possession of the article, etc.), the term "security element" as used throughout the specification is meant to include any and all of these types of theft prevention-hindrance-benefit denial devices. Furthermore, it should be understood that in all of the subsequent discussion, the type of security element associated with the novel security tag forms no limitation on the invention.

The multi-attach disposable security tag (MADST) comprises a housing containing a security element therein and that also operates by emitting a resonant signal as in the case of an EAS element or via a backscatter mechanism when a RFID element is energized by an interrogator or RFID reader. However, the MADST is a one-time use device that permanently receives one end of an attachment clip within the housing. A wide variety of attachment clip configurations can be used with the MADST, e.g., elongated attachment clips, rounded attachment clips, split attachment clips, clamping attachment clips, etc., but they can only be used once with any MADST.

All of the attachment clips comprise a non-ferrous material, preferably plastic. Moreover, all parts of the MADST housing comprise non-ferrous material, e.g., plastic. In fact, all portions, internal and external, of the housing comprise plastic (e.g., polyethylene, PVC (poly vinyl chloride) including polymers, other plastic materials, acrylonitrile-butadiene-styrene).

The shape of the MADST housing portions is shown in the figures as a rectangular shape but it should be understood that that is only by way of example and that an unlimited number of shapes (e.g., triangular, etc.) can be used for the housing portion. Regardless of the selected shape for the housing, the size of the housing is large enough (e.g., it has an outer dimension greater than 31.9 mm, the choking threshold standard) to avoid being a choking hazard to an infant or toddler.

As with application Ser. No. 12/887,229, one of the key features of the present invention is that any and all of the attachment clips described herein, can be initially secured to the article by itself without the MADST housing being coupled thereto. This is an important feature of the present invention because it allows an article manufacturer or assembler to only secure one portion, i.e., the attachment clip of the MADST to the article at a first location (e.g., the article manufacturing or assembly facility) while the MADST housing is secured to the attachment clip at a different second location (e.g., a retail establishment, etc.). As a result, the MADST housing does not have to be provided to the article manufacturer or assembler. Furthermore, since the attachment clip is the only portion of the MADST attached to the article by the manufacturer or assembler, the article can be processed in its normal course which, in many circumstances, may include being subjected to harsh manufacturing environments (e.g., if the article is a pair of jeans, the harsh manufacturing environment may involve "stone-washing") to which the attachment clip is impervious or which does not interfere with the attachment clip's function. This also avoids the need to ship the MADST housing portion and similarly eliminates the potential of damaging the MADST housing during shipping to, or from, the manufacturer or assembler.

Therefore, the MADST is attached to the article in two stages. In the first stage, the attachment clip is attached to the article during preparation or assembly of the article. Unlike a complete security tag (e.g., one which includes a security element), this attachment clip is attached to the article before the article has been treated (e.g., if the article is a pair of jeans, the attachment clip is secured to the jeans, e.g., via a belt loop, after which the jeans are then dyed or pre-washed) without suffering damage. As will be discussed in detail later, the attachment clips, such as those shown in FIGS. 1, 5-8, 11-16 are securely attached to the article so that they do not disengage from the article during article treatment (e.g., washing) and during shipping to their destination. In a second stage, after the article is treated and/or shipped to a presentation location (e.g. a retail environment), the MADST housing containing the security element is then attached to the attachment clip. Since the attachment clip is already secured to the article, the MADST housing can be attached quickly to the article by simply snapping the MADST housing and attachment clip together. The attachment of the MADST housing can be accomplished at a retail establishment thousands of miles away from the article preparation facility or location. Thus, the present invention satisfies a need for a low cost, non-ferrous, lightweight, reusable or deactivatable hard tag that can be easily formed in a two stage process, namely, securing an attachment clip to the article first and then securing a housing, comprising a security element, at a later time and/or location.

As mentioned earlier, FIGS. 1-20 are directed to the multi-attach disposable security tag (MADST) which also comprises a housing containing a security element therein and that also operates by emitting a signal via a backscatter mechanism when energized by an interrogator or RFID reader. The MADST is a one-time use device that permanently receives one end of an attachment clip within the housing. Again, a wide variety of attachment clip configurations can be used with the MADST, e.g., elongated attachment clips, rounded attachment clips, split attachment clips, clamping attachment clips, etc., but they can only be used once with any MADST.

FIGS. 1-4 show a disposable embodiment 720 using an attachment clip 724. The aperture for the attachment clips in the disposable embodiment is located along the edge of the disposable embodiment housing 722, rather than in one of the two portions 722A/722B of the housing 722. Furthermore, because of the relatively "flat" configuration of the disposable housing 722, indicia 723 can be placed on one or both of the housing portions 722A/722B, e.g., a pressure sensitive label 723, to provide a variety of messages, including warnings, product logos, instructions on how to remove the tag when purchased, etc. Alternatively, this indicia can be etched or molded into the surface of the housing potions 722A/722B.

It should be noted that the entire attachment clip is non-ferrous, e.g., plastic. (e.g., polyethylene, PVC (poly vinyl chloride) including polymers, other plastic materials, acrylonitrile-butadiene-styrene).

As with all of the other previously-discussed embodiments, the security element that may be contained within the disposable embodiment 720 imposes no limitation on the invention and may include, by way of example only, an RFID (radio frequency identification) chip/antenna, or a resonant coil/capacitor circuit 727, as shown in FIG. 2, with 727A forming the coil and 727B comprising the capacitor (of which only one capacitor plate is shown in FIG. 2). The security elements used in the disposable embodiment 720 must be deactivatable to avoid setting off any pedestal alarms once the items to which the disposable embodiment 720 is attached is purchased. Although there are several ways of deactivating a security element, one exemplary method is to use a "dimple"

721 that is positioned on one of the capacitor plates of the capacitor 727B. By way of example only, the dimple 721 is shown in FIG. 2. To that end, the dimple 721 basically comprises an indented or weakened portion of the capacitor plate. When this dimple 721 is subjected to a particular voltage pulse (from a deactivator, not shown, located at the point of sale (POS)), the pulse causes the capacitor plates to short together or otherwise alter the resonant frequency of the security element 727 such that when the article along with the security tag pass through the interrogation pedestals at the retail establishment exit, the security element will not respond to the interrogation signal of the pedestals and thus no alarm is triggered.

Figure 4:
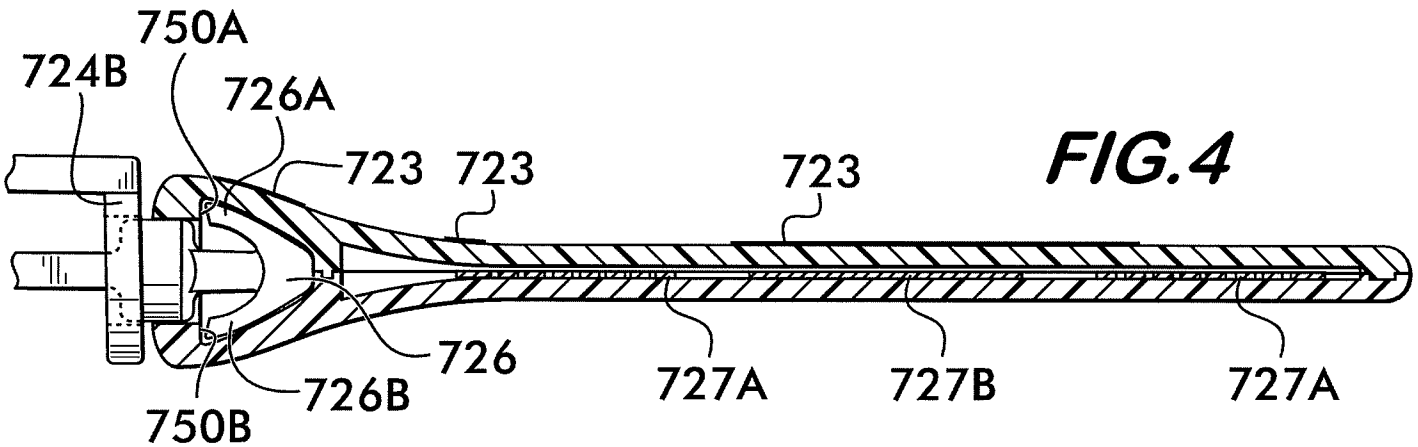
FIG. 4 is a cross-sectional view of the disposable embodiment taken along line 4-4 of FIG. 3.

As shown most clearly in FIG. 2, the hard tag housing 722 comprises a first portion 722A and a second portion 722B that are fixedly secured (e.g., ultrasonically welded) together. Alignment posts 731A/731B and corresponding alignment receptacles 733A/733B are provided in respective housing portions to align the portions to form the aperture 725 that receives an insert (e.g., a dual barb 726) of attachment clip 724 that is lockable within the aperture 725. In its original state (not shown), the attachment clip 724 comprises the dual barb 726 at one end, a body 724A and a ring 724B that is formed in a perpendicular orientation with respect to a longitudinal axis of the body 724A. To use the attachment clip 724, one end (e.g., either dual barb 726 or ring 724B) is passed through or around the item to which the security tag will be disposed. The attachment clip 724 is then folded and the dual barb end 726 is passed through the ring 724B and then the dual barb 726 is inserted into the opening 725 as shown in FIG. 4. The dual barb 726 tangs 726A/726B flex inward as they pass through the ring 724B and when they pass through the opening 725. Once inside, the barb tangs 726A/726B restore to their expanded state, thereby locking against the stop surfaces 750A and 750B which prevent the dual barb 726 from being pulled back out of the opening 725.

Figure 6:
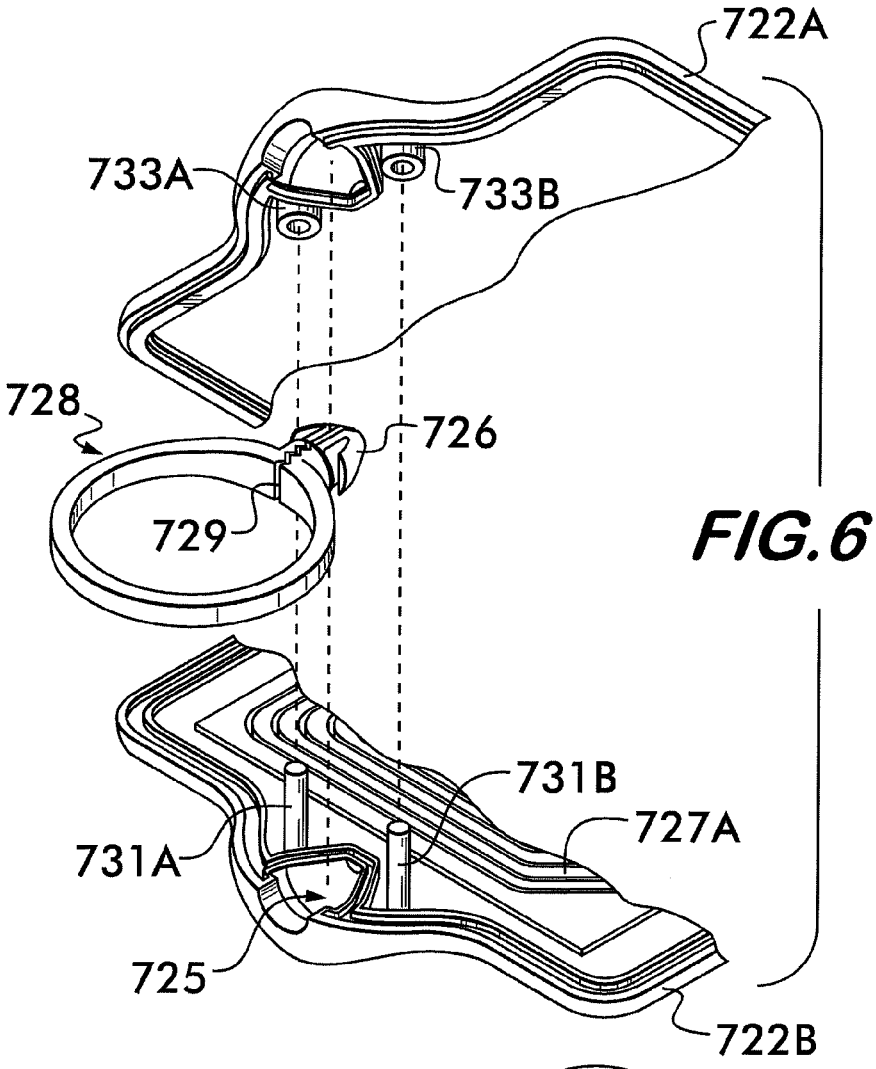
FIG. 6 is a partial exploded view of the disposable embodiment of FIG. 8.
Figure 7:
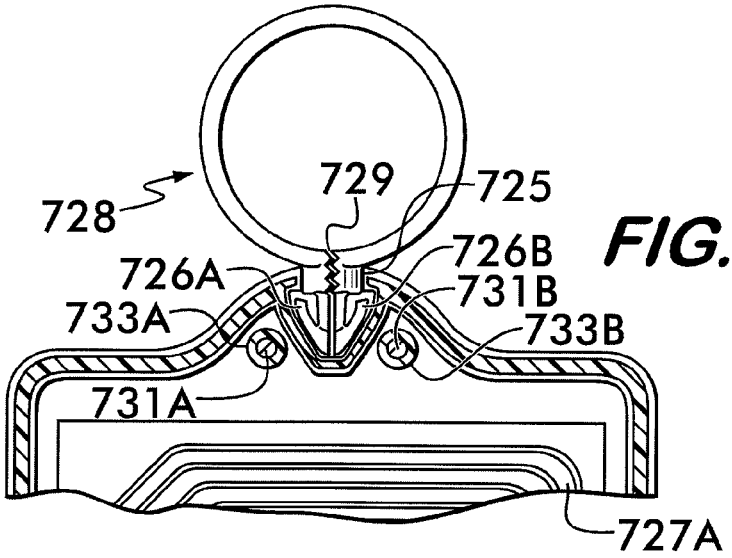
FIG. 7 is a partial plan and cross-sectional view of the disposable embodiment showing the round split clip inserted therein.
Figure 8:
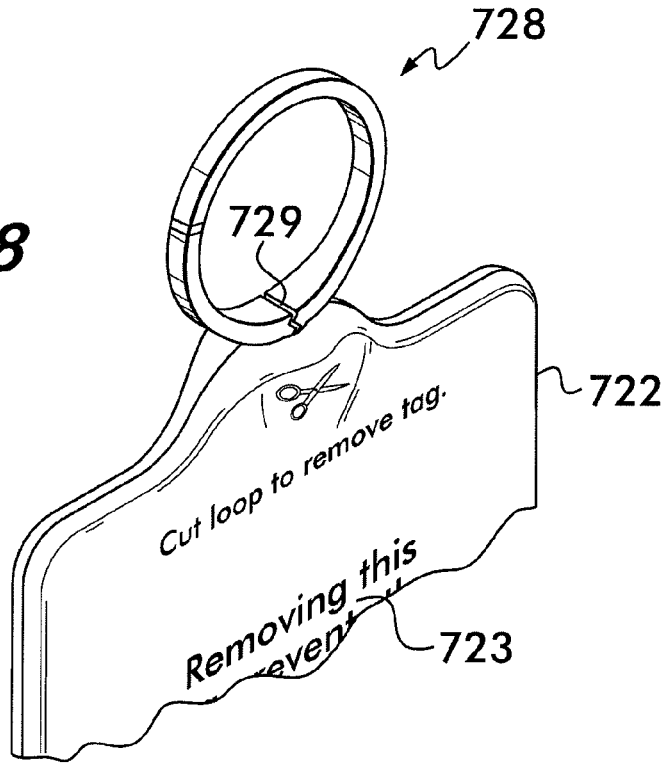
FIG. 8 is a partial isometric view of the disposable embodiment showing the round split clip inserted therein.

FIGS. 5-8 depict the disposable embodiment 720 but using a "round split clip" 728 attachment clip. This clip 728 uses the dual barb 726 as discussed previously. However, this clip includes a portion 729 that is severed that allows the user to spread the attachment clip in order to place it around or through a portion of the article (not shown) to which the disposable embodiment 720 will be attached before inserting the dual barb 726 into the opening 725. FIG. 6 is a partial exploded view of the disposable tag 720 using the round split clip 728 and FIG. 7 is a partial plan view of that embodiment showing the dual barb 726 inserted within the aperture 725. FIG. 8 is a partial isometric view showing the round split clip 728 inserted within the tag housing 722.

It should be further understood that all of the attachment clips comprise at least one portion that is insertable into the housing containing the security element. The housing of the present invention is never assembled with one portion of the attachment clip already positioned in one shell or portion of the housing to which the other housing shell or portion is then attached.

Figure 9:
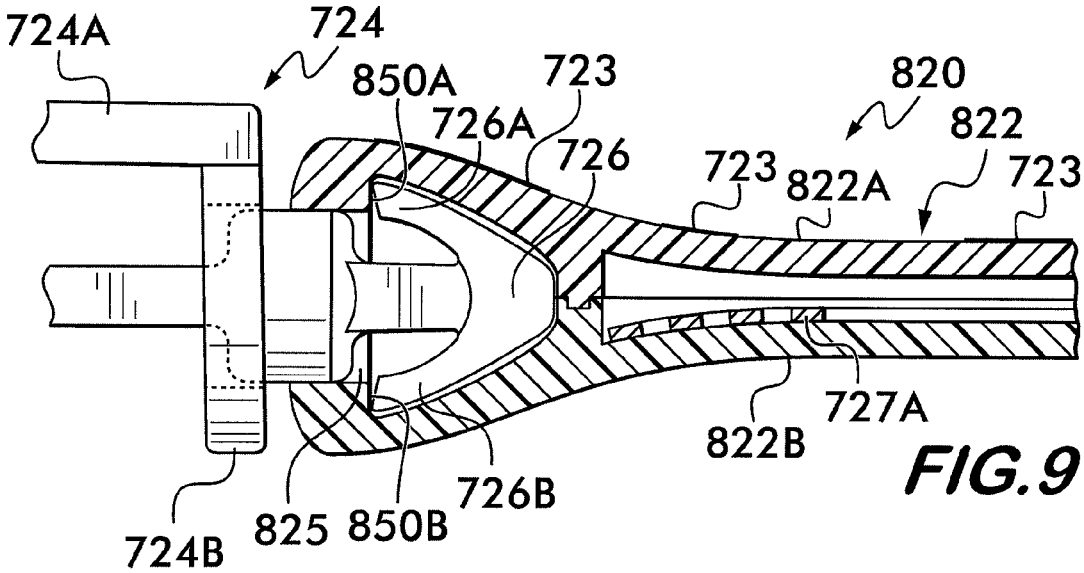
FIG. 9 is a second embodiment of the disposable version of the present invention having a rounded housing and also containing an exemplary coil/capacitor resonant circuit that is deactivatable and showing the first attachment clip having the double barb being inserted therein.
Figure 10:
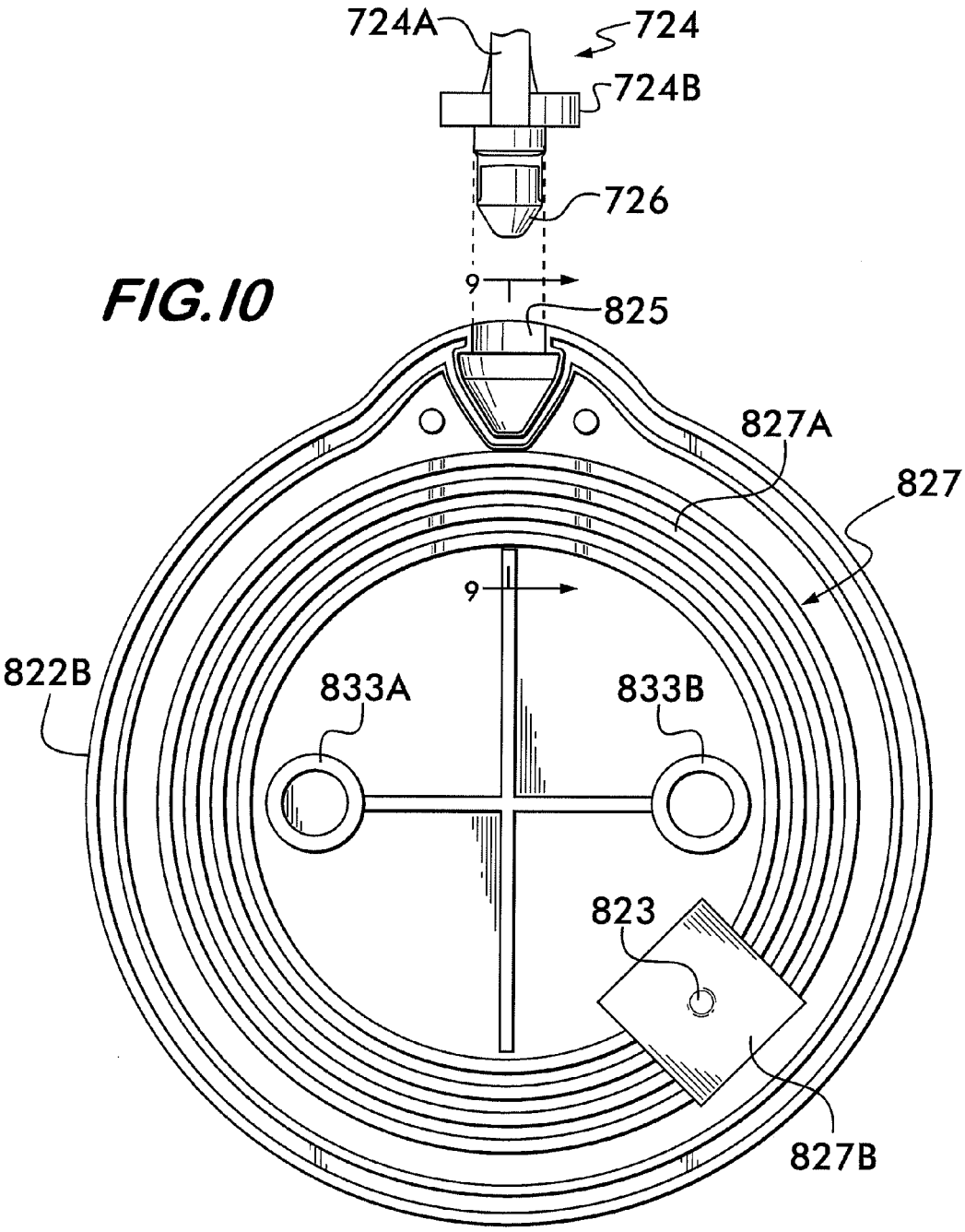
FIG. 10 is enlarged plan view of the second portion of the housing showing the exemplary security element therein.

FIGS. 9-16 depict another version 820 of the disposable embodiment that utilizes a round-shaped housing 822 for receiving the various attachment clips using the dual barb 726. As with the other disposable embodiments, the security element that may be contained within the disposable embodiment 820 imposes no limitation on the invention and may include, by way of example only, a deactivatable RFID (radio frequency identification) chip/antenna, or deactivatable resonant coil/capacitor circuit 827, as shown in FIG. 10, comprising a coil 827A and a capacitor 827B (of which only one capacitor plate is shown in FIG. 10). As with the resonant coil/capacitor circuit 727, the circuit 827 is also deactivatable and may comprise a "dimple" 823 on one of the capacitor plates of the capacitor 827B and operates similarly to the dimple 723 discussed previously.

As shown most clearly in FIG. 9, the hard tag housing 822 comprises a first portion 822A and a second portion 822B that are fixedly secured (e.g., ultrasonically welded) together. Alignment receptacles 833A/833B (FIG. 10) are provided in the second housing portion 822B to receive alignment posts (not shown) located in the first housing portion 822A. When fixedly secured together, the housing portions 822A/822B form the housing 822 that includes an aperture 825 that receives the dual barb 726 of attachment clip 724. In its original state (not shown), the attachment clip 724 comprises the dual barb 726 at one end, the body 724A and the ring 724B that is formed in a perpendicular orientation with respect to the body 724A. To use the attachment clip 724, one end (e.g., either dual barb 726 or ring 724B) is passed through or around the item to which the security tag will be disposed. The attachment clip 724 is then folded and the dual barb end 726 is passed through the ring 724B and then the dual barb 726 is inserted into the opening 825 as shown in FIG. 10. The dual barb 726 comprises the tangs 726A/726B which flex inward as they pass through the ring 724B and when they pass through the opening 825. Once inside, the barb tangs 726A/726B restore to their expanded state, thereby locking against the stop surfaces 850A and 850B which prevent the dual barb 726 from being pulled back out of the opening 825.

FIGS. 11-16 depict various attachment clips that can be used with the disposable embodiments and it should be understood that although the rounded housing 822 is shown partially, any disposable embodiment can easily be used with these attachment clips. In particular, these attachment clips includes a first portion that secures to the article (see FIGS. 11-16) and also includes the dual barb 726 that is captured within the disposable embodiment housing 722 or 822. As mentioned previously with the other attachment clips, the entire attachment clip is non-ferrous, e.g., plastic. (e.g., polyethylene, PVC (poly vinyl chloride) including polymers, other plastic materials, acrylonitrile-butadiene-styrene).

Figure 11:
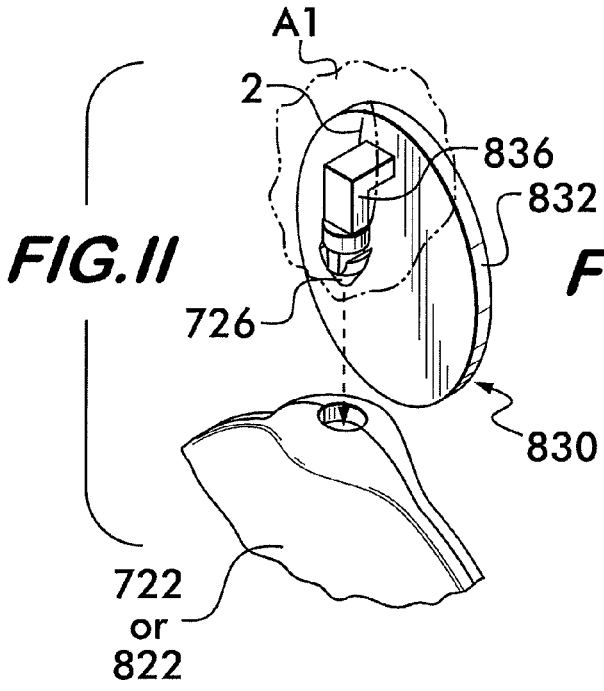
FIG. 11 is a partial isometric view showing the double barb element used on a button-hole type of attachment clip being inserted into the disposable embodiment.

FIG. 11 depicts a button-hole type of attachment clip 830 for use with an article A1 (e.g., a coat or jacket, etc.). In particular, the attachment clip 830 comprises a blocking member 832 (e.g., a disc) having the dual barb 726 integrated therein. When the article A1 is being manufactured, the blocking member 832 is placed against the article A1 and the dual barb 726 is positioned through what later becomes the button hole 2 during coat manufacturing. As a result, the blocking member 832 is secured to the article A1 and cannot be removed without damaging the article A1. The coat, with the attachment clip 830 secured thereto, is then shipped to the distributor, or retailer, etc., where the housing 722 or 822 is then coupled via the dual barb 726, as described previously. Once the item is purchased, the customer can cut or sever (e.g., using a scissors, or a knife, etc.) the attachment clip 830 at location 836 to remove both the housing 722/822 and the disc 832 from the article A1. It should be understood that although attachment clip 830 uses a blocking member 832 formed into a disc, this is by way of example only; a variety of different shapes could work easily as well. In fact, any member larger than the button hole 2 would suffice in that such a member would be "blocked" or prevented from passing through the button hole 2.

Figure 12:
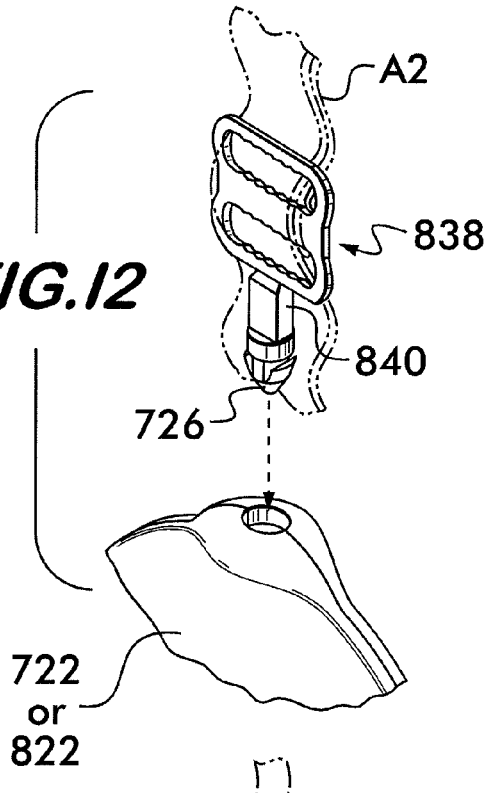
FIG. 12 is a partial isometric view showing the double barb element used on an adjustment bracket type of attachment clip.

FIG. 12 depicts an adjustment bracket type of attachment clip 838 for use with an article A2 (e.g., a brassiere strap, water goggles, etc.) whose tightness for wear can be adjusted. In particular, the present invention integrates the dual barb 726 with this adjustment bracket. Therefore, during article manufacture, the adjustment bracket 838 is positioned on the article A2 in its normal course. The article A2 is then shipped to the distributor, or retailer, etc., where the housing 722 or 822 is then coupled via the dual barb 726, as described previously. Once the item is validly purchased, the customer can cut or sever the fluke at location 840 to remove the housing 722 or 822 from the article A2. It should be noted that the adjustment function of the attachment clip 838 remains unhindered once the dual barb 726 is cut or severed from the attachment clip 838.

Figure 13:
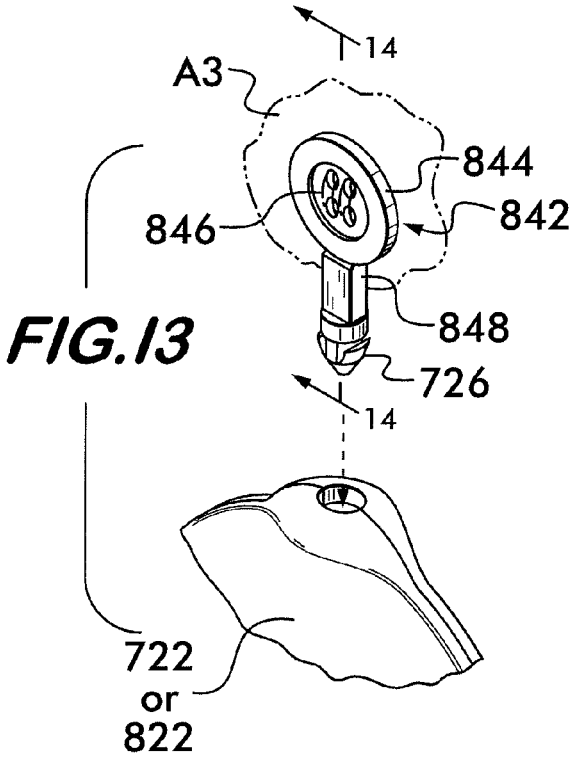
FIG. 13 is a partial isometric view showing the double barb element used on a sew-on type of attachment clip.

FIG. 13 depicts a "sew-on" type of attachment clip 842 for use with an article A3. In particular, the attachment clip 842 comprises a first end 844 that mimics a button design having apertures for receiving threads 846 to secure the attachment clip 842 to the article A3. During the manufacture of the article A3, the first end 844 is sewn to the article A3. The article A3 is then shipped to the distributor, or retailer, etc., where the housing 722 or 822 is then coupled via the dual barb 726, as described previously. Once the item is purchased, the customer can cut or sever the fluke at location 848 to remove the housing 722 or 822 from the article A3; alternatively, the threads 846 can be severed by the customer to remove the first end 844.

Figure 16:
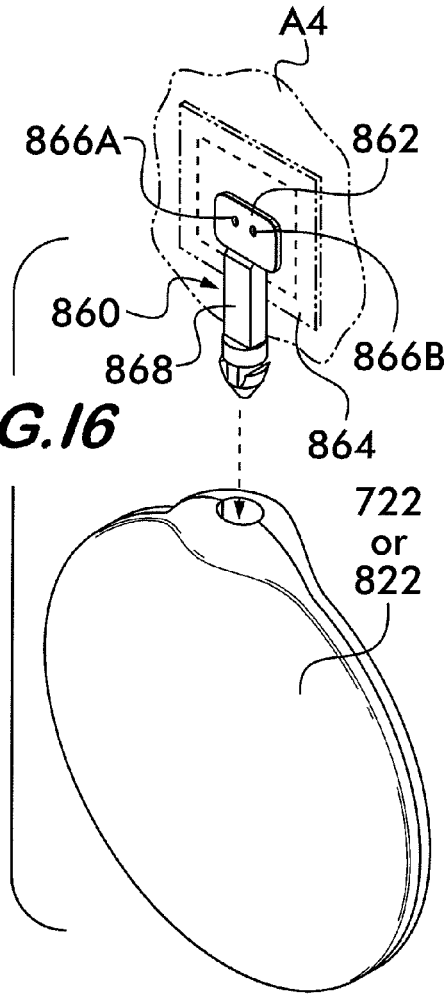
FIG. 16 is an isometric view of a fabric type of attachment clip that is being inserted into a disposable embodiment of the present invention.
Figure 19:
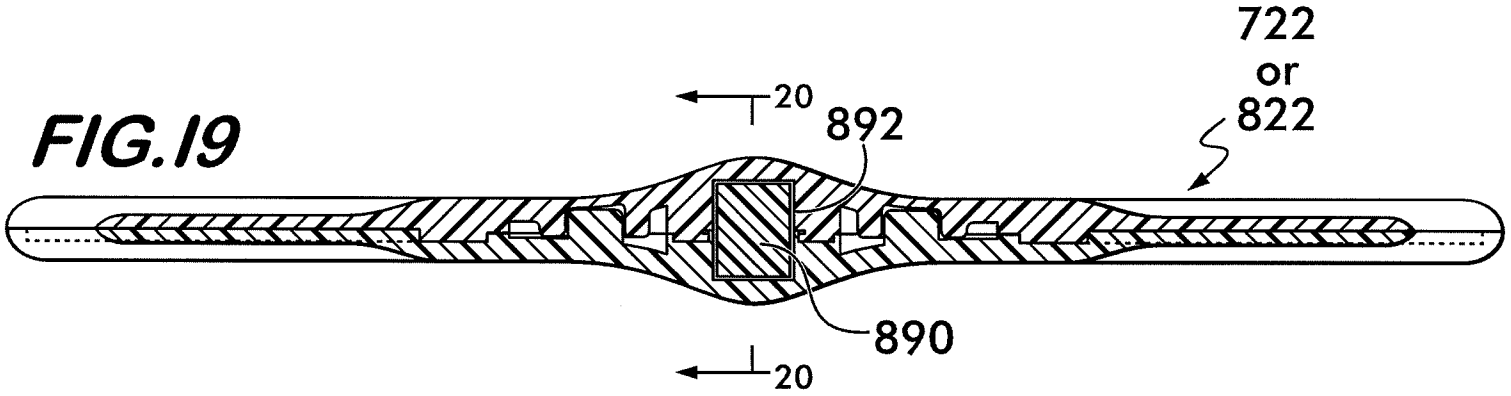
FIG. 19 is a cross-sectional view of the disposable tag housing taken along line 19-19 of FIG. 17.
Figure 20:
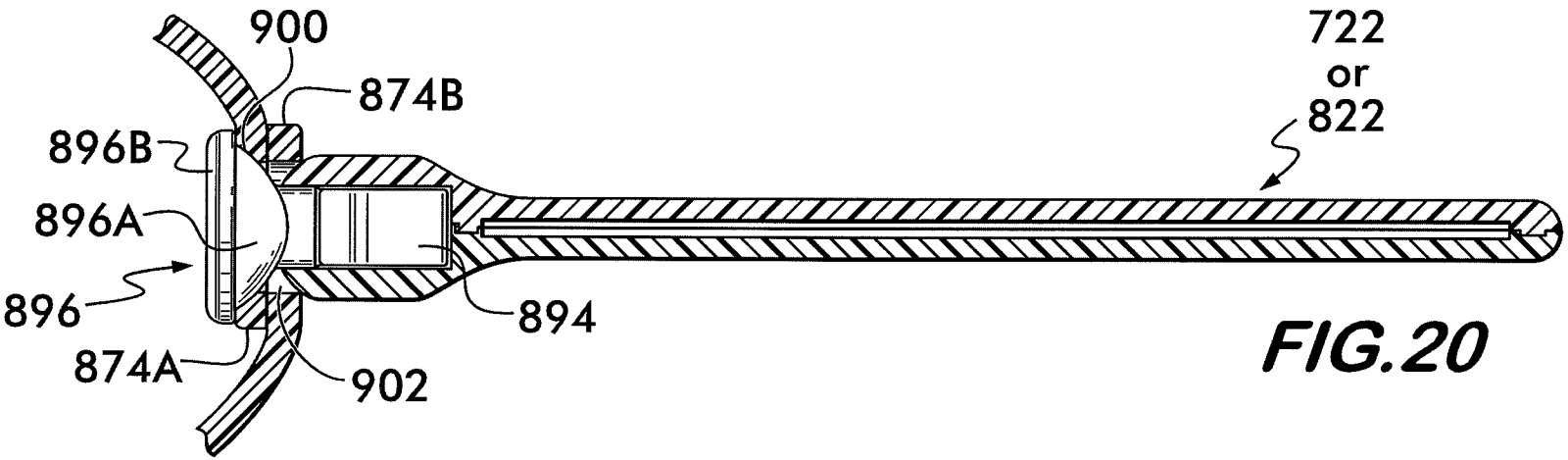
FIG. 20 is a cross-sectional view of the disposable tag taken along line 20-20 of FIG. 19 showing how the rotatable attachment clip is coupled to the tag housing using the connecting element.
Figure 21:
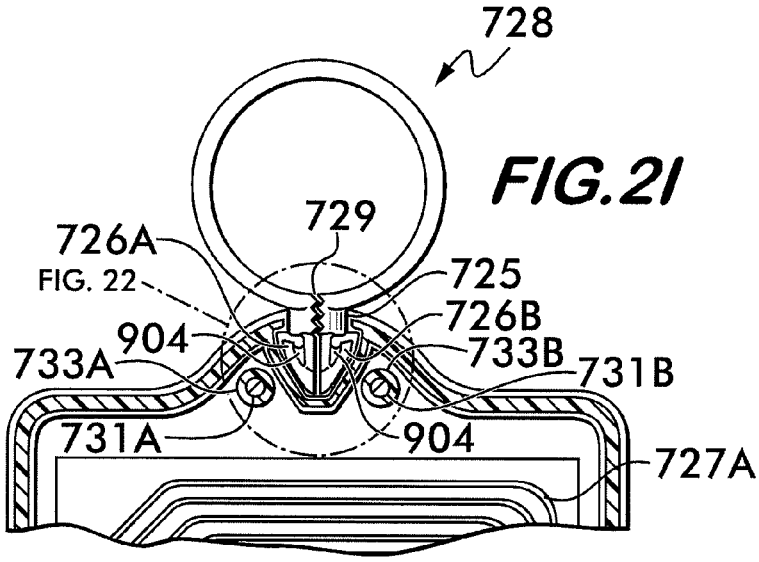
FIG. 21 is a partial plan and cross-sectional view of the disposable embodiment showing the round split clip, using a "webbed" dual barb, inserted therein.
Figure 22:
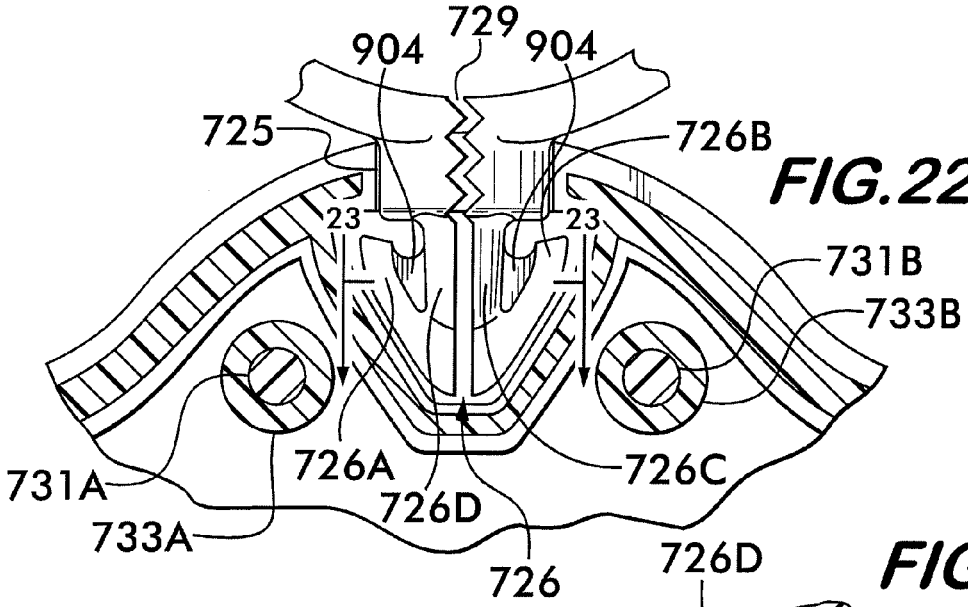
FIG. 22 is an enlarged view of the circled portion of FIG. 21 showing the round split clip using the webbed dual barb inserted within the disposable embodiment.
Figure 23:
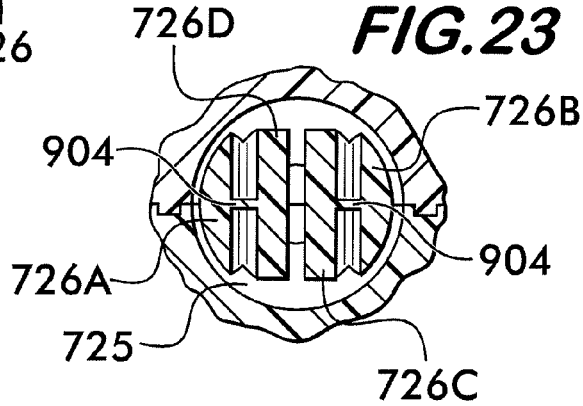
FIG. 23 is a cross-sectional view of the disposable embodiment taken along line 23-23 of FIG. 22.

FIG. 16 depicts a fabric type of attachment clip 860 for use with an article A4. In particular, the attachment clip 860 comprises a first end 862 that can be either welded (e.g., ultrasonic), or sewn to, a piece of fabric 864 that is then sewn or otherwise coupled to the article A4. As can be seen in FIG. 16, the first end 862 comprises apertures 866A/866B for receiving threads (not shown) for alternatively securing to the piece of fabric 864. The article A4 is then shipped to the distributor, or retailer, etc., where the housing 722 or 822 is then coupled via the dual barb 726, as described previously. Once the article A4 is purchased, the customer can cut or sever the fluke at location 868 to remove the housing 722 or 822 from the article A4; alternatively, the threads (not shown) passed through the apertures 866A/866B can be severed by the customer to remove the first end 862; another alternative would be to sever threads (also not shown) that couple the fabric 864 to the article A4.

Figure 14:
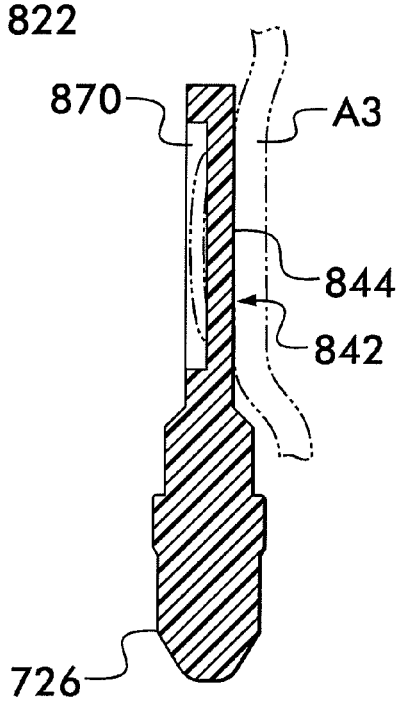
FIG. 14 is a cross-sectional view of the sew-on type of attachment clip taken along line 14-14 of FIG. 13 showing a tamper-indicative material applied over the recessed area where the threads pass through the holes.
Figure 15:
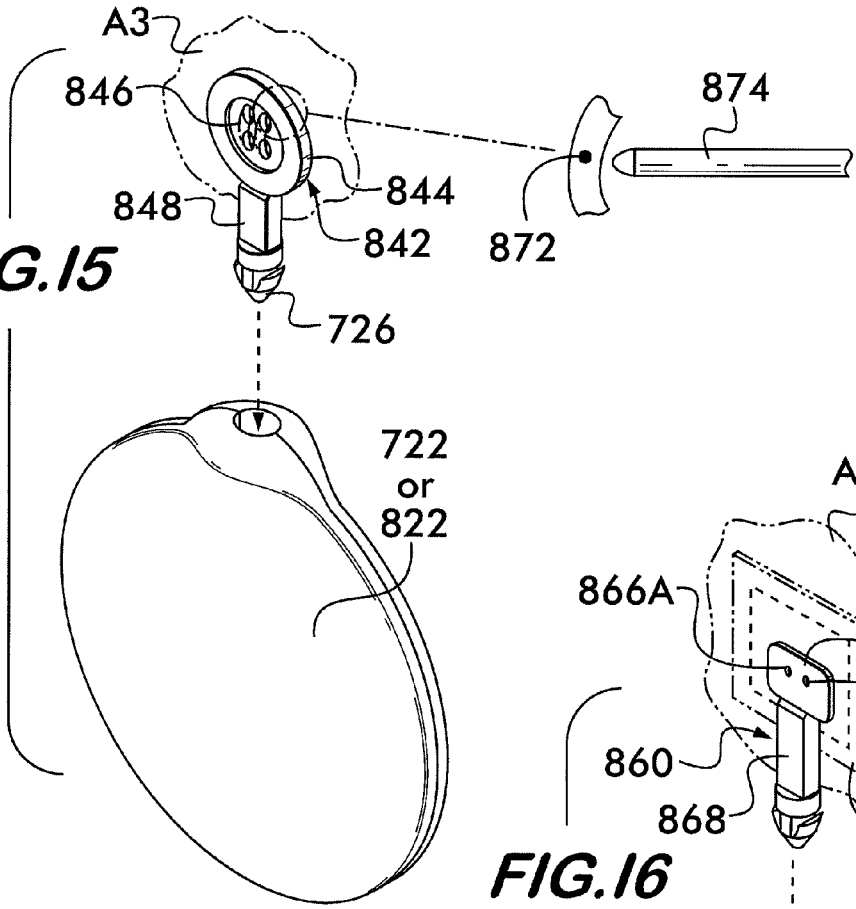
FIG. 15 is an isometric view of the sew-on type of attachment clip being inserted into a disposable embodiment and including an enlarged view of a thread having an ultraviolet indicia associated therewith so that when an ultraviolet light source is directed at that indicia, the ultraviolet indicia illuminates.

FIGS. 14-15 provide a mechanism that prevents users from improperly attempting to return items after purchase, e.g., the person uses the item once and then returns it. Where articles of clothing are involved, the customer is using the retail establishment as a personal "wardrobe" using and returning such clothing as he/she would do with their clothing in their closet. To prevent customers from such "wardrobing," the following discussion provides "anti-wardrobing" mechanisms. As can be seen from FIG. 1, a warning can be provided to the customer that if the disposable tag is removed from the article, the article cannot be returned. Thus, by cutting the attachment clip, the customer knows that he/she cannot return the article. However, if the customer removes the disposable tag by decoupling the first end of the attachment clip and then later attempts to re-connect the first end, FIGS. 14-15 provide a mechanism for detecting such "re-attachment." For example, as shown in FIG. 14, the attachment clip 842 is used to secure the disposable tag to the garment A3 using threads 846. A tamper-indicative material 870 (opaque or clear) is applied over the apertures in the first end 844. If this material is ruptured or removed or otherwise tampered with, this "corrupted adhesive" provides immediate notice to the store personnel at the "returns department" that the customer most likely removed the threads and then re-sewed the attachment clip 842 to the article A3. Alternatively, as shown in FIG. 15, a portion or portions of the thread 846 can be treated with an indicator 872, e.g., an ultraviolet indicator, which is invisible to the naked eye. However, when an ultraviolet light source 874, e.g., an ultraviolet penlight, is directed at that thread, the ultraviolet (UV) indicator 872 illuminates. Therefore, when the attachment clip 842 is first applied to the article A3, the threads 846 used comprise this UV indicator. If a customer after purchasing the article A3 and removing the threads 846 and then later re-sews the attachment clip 842 to the article using common thread, when the "returns personnel directs a UV light at the threads, no UV indicator illuminates, thereby evidencing that new threads were used and that disposable tag had been previously removed by the customer. Another alternative is to utilize "nano taggants". Nano taggants are markers that are placed within the fiber structure of the thread and that any rupture in those threads, when placed under a microscope can readily indicate when a fiber has been severed and reconnected.

As can be seen most clearly in FIG. 2 (as well as FIGS. 6 and 10), the dual barb 726 has a "rounded" outer surface so that the attachment clips 724 and 728 (or any of the other attachment clips using dual barb 726) can be swiveled or rotated with respect to the housing 722 once the dual barb 726 is inserted within the housing 722/822. Thus, it should be understood that any of the previous embodiments involving the dual barb 726 permit the attachment clip to be swivelable or rotatable continuously with respect to the housing 722 or 822. This feature important to prevent would-be thieves from trying to "twist-off" the attachment clip from the housing, as well as providing the retail establishment the ability to manipulate the MADST embodiment while on the article to provide a nice display or presentation. It should be understood that the terms "swivelable" and "rotatable" are interchangeable as used throughout this Specification.

FIGS. 17-20 depict the MADST embodiment 720 or 820 (by way of example only; any of the MADST embodiments could be used) used with an attachment clip that can also swivel externally of the tag housing. However, unlike the previous embodiments, where the dual barb 726 is rotatable within the housing 722 or 822, the second portion of the embodiment depicted in FIGS. 17-20 does not swivel or rotate within the housing 722 or 822; instead, the portion inserted within the housing 722 or 822 remains stationary and the attachment clip body swivels around the inserted portion. As discussed previously, this rotating or swiveling feature is important to prevent would-be thieves from trying to "twist-off" the attachment clip from the housing, as well as providing the retail establishment the ability to manipulate the MADST embodiment while on the article to provide a nice display or presentation.

In particular, FIG. 17 depicts an attachment clip 874 that is freely rotatable about a connecting element axis 876. Thus, when the attachment clip 874 is secured to the tag housing 722 or 825, it can swivel freely in the directions of double-headed arrow 878; in other words the attachment clip 874 is also swivelable or rotatable continuously with respect to the housing 722 or 822 In particular, the attachment clip 874 comprises apertured ends 874A and 874B connected by the attachment clip body 874C. Once the attachment clip 874 is passed through or around the item of merchandise (not shown) it is to protect, the two ends 874A and 874B are aligned as shown in FIG. 18. Next, a fluke element 890 (also referred to as a "connecting element") secures the attachment clip 874 to the housing 722 or 822 via a modified opening 892. The fluke element 890 comprises the fluke dual barb 894 having tangs 894A and 894B at one end and an end cap 896 at the other end. The end cap 896 comprises a bulbous element 896A that is integrally formed with a circular flange 896B, as shown most clearly in FIG. 20. The circular flange 896B has an area that is greater than the apertures of the ends 874A and 874B so that when the fluke dual barb 894 is passed through the aligned apertures, the ends 874A and 874B are trapped against the circular flange 896B. With dual barb 894 locked within the tag housing 722 or 822, the two ends 874A/874B of the attachment clip 874 are trapped between the tag housing 722 or 822 and the end cap 896 and their apertures are aligned so that they can slide over the fluke element 890 and the ends 874A/874B are free to rotate about the connecting element axis 876. Thus, not only is the attachment clip swivelable or rotatable continuously with respect to the housing 722 or 822 but is also swivelable or rotatable continuously with respect to the fluke element 890.

It should be noted that the aperture 892 in the edge of the tag housing 722 or 822 is modified to accommodate the fluke dual barb 894. In particular, as can be seen most clearly in FIG. 18, the fluke dual barb 894 is "block-formed" as opposed to being "rounded" as most clearly seen in FIGS. 1 and 6 where the dual barb 726 has a slightly rounded contour. The "rectangular-shaped" aperture 892 (FIGS. 18 and 19) accommodates this so that the tangs 894A/894B are compressed and then expand to be locked against corresponding aperture stops 898A/898B when the fluke dual barb 894 is inserted into the aperture 892. This "block form" of the fluke dual barb and the "rectangular-shaped" aperture 892 prevent the fluke element 890 from being rotated within the aperture 892 once inserted. Thus, although the fluke dual barb 894 is not rotatable with respect to the tag housing 722 or 822, the attachment clip 874 can rotate or swivel about the fluke dual barb 894.

It should be further noted that to ensure that the attachment clip 874 is trapped between the end cap 896 and the tag housing 722 or 822 when the fluke dual barb 894 is inserted while allowing the attachment clip 874 to be rotatable, the apertured ends 874A and 874B comprise differently shaped apertures. As can be seen most clearly in FIG. 20, the aperture of end 874A has a tapered radius 900 to provide a corresponding fit with the bulbous element 896A whereas the aperture of end 874B has a constant radius 902. As a result, the person inserting the fluke element 890 when coupling the attachment clip 874 to the tag housing 722/822, must make certain that the end 874B is in direct contact with the tag housing 722/822 and that the other end 874A is then placed against the end 874B during alignment when the fluke element 890 is then inserted through the aligned apertured ends 874A/874B and then into the aperture 892. As a result, the attachment clip 874 is free to rotate about the fluke element 890 while being trapped between the end cap 896 and the tag housing 722 or 822.

To further enhance the strength of the dual barb 726, FIGS. 21-25 illustrate a dual barb 726 that is "webbed". In particular, as shown most clearly in FIG. 22, a web 904 fills a portion of the gap between the spines 726C/726D and the tangs 726A/726B, respectively, of the dual barb 726. The web 904 also comprises plastic (e.g., polyethylene, PVC (poly vinyl chloride) including polymers, other plastic materials, acrylonitrile-butadiene-styrene). The presence of the web 904 increases the strength of the dual barb 726 thereby increasing the resistive force that a would-be thief would need to overcome if he/she attempted to pull the dual barb 726 out of the aperture 725 once locked therein. The web 904 can be compressed to allow the insertion of the dual barb 726 into the aperture 725, as discussed previously. The web 904 is formed between the spines 726C/726D and the respective tangs 726A/726B when the fluke 726 is molded. It should be understood that it is within the broadest scope of the present invention to include this web 904 in every dual barb 726 discussed previously.

A webbed fluke dual barb 894 is shown in FIGS. 24-25. In particular, as shown in FIG. 24, the web 904 fills a portion of the gap between the tangs 726A/726B and a spine 895 of the fluke dual barb 894. This can also be seen in the cross-sectional view of FIG. 25. Thus, this webbed fluke dual barb 894 can be used to enhance the strength of the fluke dual barb 894 for use with the rotatable attachment clip 874. As discussed previously, the presence of the web 904 increases the strength of the fluke dual barb 894 thereby increasing the resistive force that a would-be thief would need to overcome if he/she attempted to pull the fluke dual barb 894 out of the aperture 725 once locked therein. The web 904 can be compressed to allow the insertion of the fluke dual barb 894 into the aperture 725, as discussed previously. The web 904 is formed between the spines 726C/726D and the respective tangs 726A/726B when the fluke dual barb 894 is molded.

While the invention has been described in detail and with reference to specific examples thereof, it will be apparent to one skilled in the art that various changes and modifications can be made therein without departing from the spirit and scope thereof.

What is claimed is:

1. A security tag adapted for securing to an article, said security tag comprising:

a housing;

a locking mechanism positioned along an edge of said housing;

an attachment clip comprising a first portion configured to secure to the article independently of said housing; and a second portion configured to permanently secure within said locking mechanism of said housing, and wherein at least a portion of said attachment clip is rotatable with respect to said housing; and a deactivatable security element associated with said housing, said security element preventing or hindering a theft of the article.

2. The security tag of claim 1 wherein said housing comprises an aperture located along an edge of said housing and wherein said second portion comprises an insert that is insertable within said aperture and which is rotatable within said aperture.

3. The security tag of claim 2 wherein said aperture forms an annular stop within said housing and wherein said insert is compressed as it passes through said aperture and then expands, wherein said insert is trapped against said annular stop.

4. The security tag of claim 3 wherein said insert comprises a dual barb.

5. The security tag of claim 4 wherein said dual barb comprises a spine having tangs on either side of said spine such that a gap is formed between each tang and said spine and wherein a web is disposed in each gap between said tang and said spine.

6. The security tag of claim 4 wherein said attachment clip comprises:

a body having a first end which includes a ring that is oriented perpendicular to a longitudinal body axis and wherein said first end and said body form said first portion;

a second end formed by said dual barb; and wherein said attachment clip is passed through or around the article and said dual barb is passed through said ring and inserted into said aperture in said edge of said housing.

7. The security tag of claim 4 wherein said attachment clip comprises:

an annular body that forms said first portion and including a split in said annular body wherein said dual barb is formed as said second portion, said split permitting said annular body to be spread open to permit passing a said annular body through or around a portion of the article to be protected and wherein said dual barb is then inserted into said aperture in said edge of said housing.

8. The security tag of claim 7 wherein said dual barb is split to form a first spine and tang element and a second spine tang element and wherein each spine and tang element comprises a gap formed between said spine and said corresponding tang, and wherein a web is disposed in each gap between said spine and said tang.

9. The security tag of claim 3 wherein said first portion comprises one selected from a group consisting of a blocking member that cannot pass through an opening in the article, an adjustment bracket, a plurality of apertures through which threads can be passed for securing said attachment clip to the article, and a surface that is secured to a fabric element and wherein said fabric element is secured to the article.

10. The security tag of claim 9 wherein said first portion comprises a plurality of apertures through which threads can be passed for securing said attachment clip to the article.

11. The security tag of claim 10 wherein at least a portion of said threads comprises an ultraviolet marker that illuminates when exposed to ultraviolet light.

12. The security tag of claim 10 wherein a tamper-evident material is applied over said threads, said material being punctured or otherwise corrupted to indicate threads may have been tampered with.

13. The security tag of claim 10 wherein at least a portion of said threads comprises a nano taggant material.

14. The security tag of claim 1 wherein said security tag is non-ferrous.

15. The security tag of claim 1 wherein said at least a portion of said attachment clip comprises said first portion that is rotatable with respect to said housing.

16. The security tag of claim 15 wherein said first portion is further rotatable with respect to said second portion.

17. The security tag of claim 16 wherein said first portion comprises an aperture at each end of said attachment clip and wherein said attachment clip is passed through or around the article and then said attachment clip is folded over to align said apertures and through which said second portion passes before being inserted within said housing.

18. The security tag of claim 17 wherein said second portion comprises a dual barb at a first end of said second portion and an end cap at a second end of said second portion, said dual barb being passed through said aligned apertures and wherein said end cap comprises an area that is larger than said apertures.

19. The security tag of claim 18 wherein said aperture forms an annular stop within said housing and wherein said dual barb is compressed as it passes through said aperture and then expands, wherein said dual barb is trapped against said annular stop.

20. The security tag of claim 18 wherein said dual barb comprises a spine having tangs on either side of said spine such that a gap is formed between each tang and said spine and wherein a web is disposed in each gap between said tang and said spine.

* * * * *